United States Patent [19]

Tamaru et al.

[11] 4,079,582

[45] Mar. 21, 1978

[54] ELECTRONIC TIMEPIECE

[75] Inventors: Munetaka Tamaru, Tokyo; Kazunari Kume; Minoru Watanabe, both of Tokorozawa; Hideshi Ohno, Sayama, all of Japan

[73] Assignee: Citizen Watch Co., Ltd., Tokyo, Japan

[21] Appl. No.: 674,221

[22] Filed: Apr. 6, 1976

[30] Foreign Application Priority Data

Apr. 22, 1975 Japan ..... 50-48946

[51] Int. Cl.[2] ..... G04B 19/02; G04B 27/00; G04C 3/00

[52] U.S. Cl. ..... 58/23 D; 58/85.5; 58/125 R; 58/138

[58] Field of Search ..... 58/23 R, 23 D, 85.5, 58/138, 125 R, 125 B

[56] References Cited

U.S. PATENT DOCUMENTS

| | | | |
|---|---|---|---|
| 3,813,873 | 6/1974 | Nakagawa | 58/85.5 |
| 3,824,781 | 7/1974 | Diersbock | 58/23 R |
| 3,842,585 | 10/1974 | Lupoli | 58/23 R |
| 3,857,235 | 12/1974 | Wolber | 58/23 D |
| 3,972,178 | 8/1976 | Beguin | 58/85.5 |

*Primary Examiner*—Stanley J. Witkowski
*Attorney, Agent, or Firm*—Koda and Androlia

[57] ABSTRACT

An electronic timepiece comprising a means for generating a base signal, an electromechanical transducer to convert the base signal into mechanical motion of a rotatable shaft, only a back side chain of wheels and a driving means whereby the back side chain of wheels is directly driven by the rotatable shaft. Furthermore, the driving means is coupled to the rotatable shaft such that idling rotation of the driving means occurs without rotation of the rotatable shaft when the timepiece is being set externally.

6 Claims, 8 Drawing Figures

ELECTRONIC TIMEPIECE

BACKGROUND OF THE INVENTION

1. Field of the Invention

This invention relates to the structure of gear trains in electronic timepieces that utilize an electrical to mechanical transducer.

2. Description of the Prior Art

FIGS. 1 and 2 illustrate a prior art electronic timepiece that uses an electrical to mechanical transducer. In the prior art electronic timepiece of FIGS. 1 and 2, a quartz crystal oscillator and a stepping motor are used. In FIGS. 1 and 2, 1 is the base plate, 2 is the receptor, 3 is the motor coil, 4 is the rotor that includes a toothed claw $4_a$ on rotor 4 and a permanent magnet $4_b$, 5 is the fourth wheel, 6 is the third wheel, 7 is the second wheel, 8 is the cannon pinion which is coupled to the second wheel 7 by friction, 9 is the back side minute wheel, 10 is an hour wheel, 11 is a setting wheel, 12 is the battery, 13 is the quartz crystal oscillator and IC circuits that are subject to pending vibration, and 14 is the stator of the motor. In the prior art electronic watch, the rotational motion of rotor 4 is passed through the so-called front side wheel chain that consists of fourth wheel 5, third wheel 6 and the second wheel 7 for the purpose of speed reduction. The rotational motion of rotor 4 is then transmitted to the so-called back wheel chain via the cannon pinion 8 and rotates the back side minute wheel 9 and the hour wheel 10. The cannon pinion 8 and the hour wheel 10 rotate the indicator hands (not shown). The numeral 15 indicates the dial washer.

Because of this construction, the front side wheel chain requires a great deal of space, and furthermore, it is located on the same level as the battery 12, creating a further obstacle to the miniaturization and thinner design of timepieces.

SUMMARY OF THE INVENTION

In keeping with the principles of the present invention, the objects are accomplished with the unique combination of a means for generating a base signal, an electromechanical transducer to convert the base signal into mechanical motion of a rotatable shaft, only a back side chain of wheels and a driving means. The electromechanical transducer converts the base signal into mechanical motion of the rotatable shaft which is coupled to the back side chain of wheels by the driving means. The driving means is arranged such that the back side chain of wheels is directly driven by the rotatable shaft and no front side chain of wheels is required. Furthermore, the driving means is coupled to the rotatable shaft such that idling rotation of the driving means can occur without rotation of the rotatable shaft when the timepiece is being set externally.

Accordingly, a general object of the present invention is to make miniaturization and thinner design of an electronic timepiece easier by eliminating the so-called front side wheel chain.

It is yet another object of the present invention to obtain more freedom in the arrangement of the battery and other components in an electronic timepiece.

It is still another object of the present invention to reduce the total number of components in an electronic timepiece.

It is also another object of the present invention to provide more room for the base signal generator and the like components which are crucial for performance of the electronic timepiece.

BRIEF DESCRIPTION OF THE DRAWINGS

The above-mentioned and other features and objects of the present invention will become more apparent by reference to the following description taken in conjunction with the accompanying drawings, wherein like reference numerals denote like elements and in which.

DETAILED DESCRIPTION OF THE PREFERRED EMBODIMENTS

Figure 1:
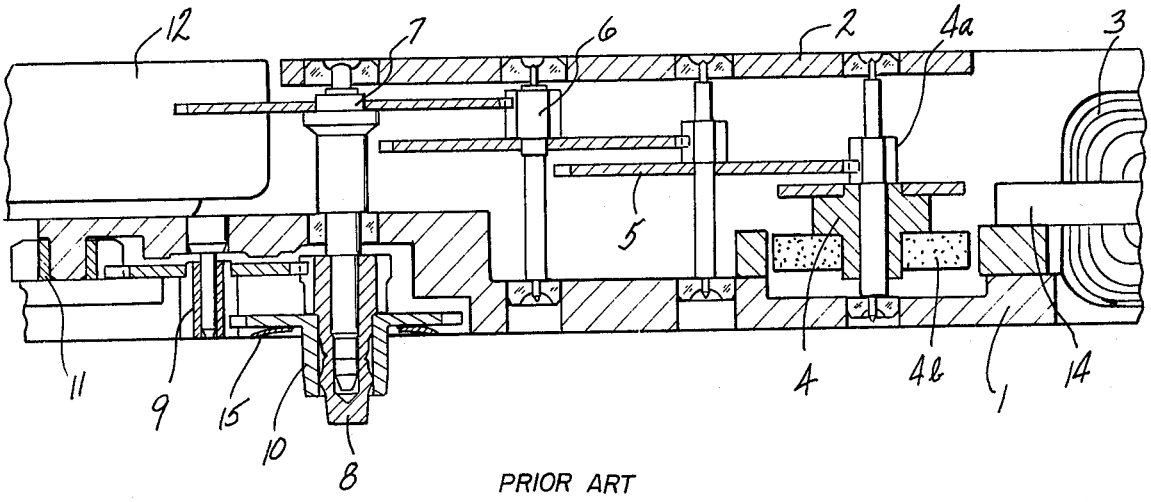
PRIOR ART FIG-1
FIG. 1 is a sectional view of a prior art electronic timepiece.
Figure 2:
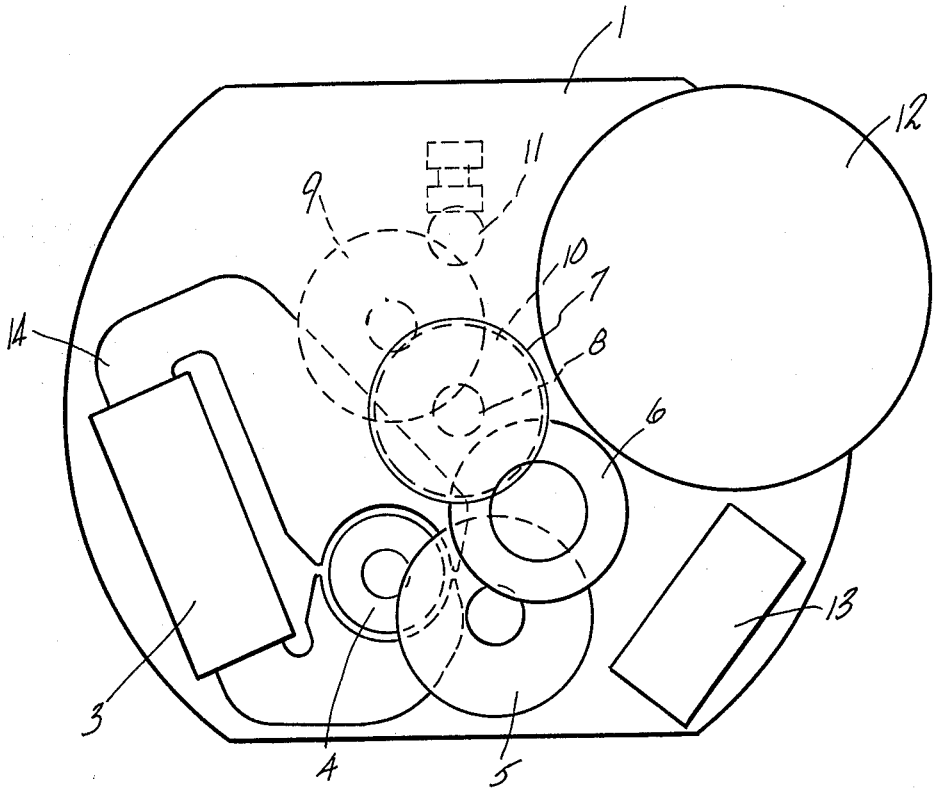
PRIOR ART FIG-2
FIG. 2 is a plan view of a prior art electronic timepiece.
Figure 3:
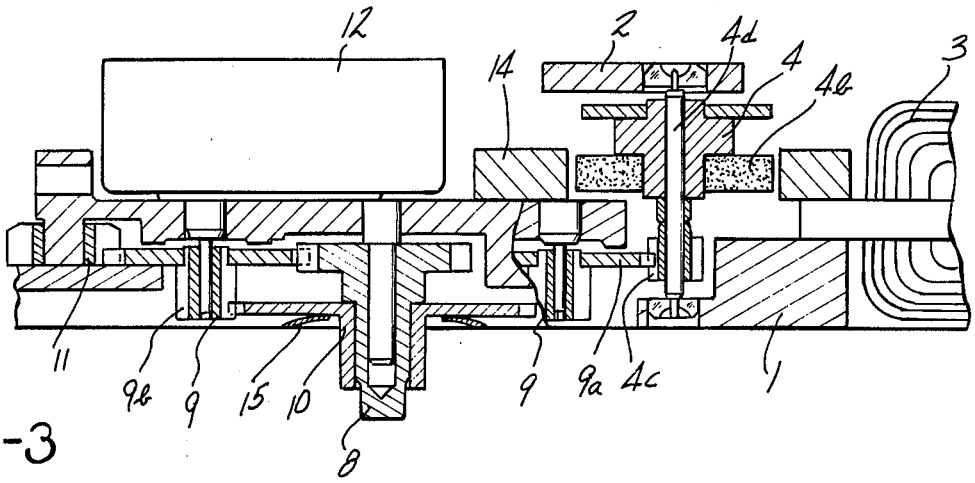
FIG. 3 is a sectional view of an embodiment of an electronic timepiece in accordance with the teachings of the present invention.
Figure 4:
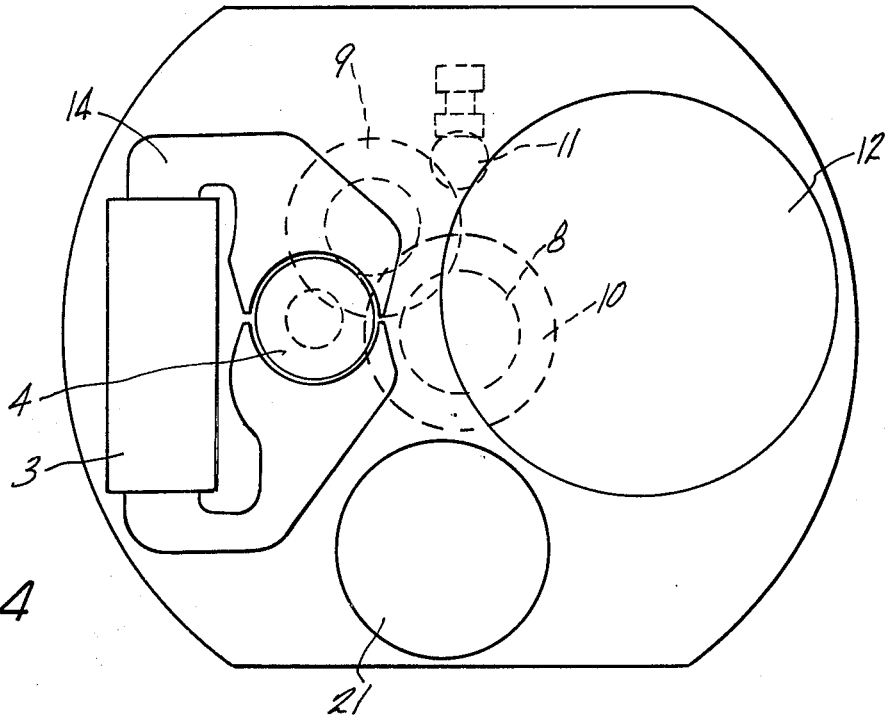
FIG. 4 is a plan view of the electronic timepiece of FIG. 3 in accordance with the teachings of the present invention.

Referring more specifically to the drawings, FIGS. 3 and 4 illustrate a first embodiment of an electronic timepiece in accordance with the teachings of the present invention. The electronic timepiece of FIGS. 3 and 4 includes a quartz crystal oscillator 21 as the base signal generator. Slip-rotor toothed claw $4_c$ is coupled to rotor shaft $4_d$ by friction and directly engages with back side minute wheel $9_a$ without going through a chain of front side wheels. By way of example, consider that the permanent magnet $4_b$ of rotor 4 is magnetized with six poles and rotates once every 6 minutes. The number of teeth for this case is 6 for the slip-rotor tooth claw $4_c$, 60 for the back side minute wheel $9_a$, 6 for the back side minute wheel pinion $9_b$, 60 for the cannon pinion 8, and 72 for the hour wheel 10. The combination of the numbers of teeth make the sizes of the toothed wheels similar and thus achieves a well balanced arrangement. In addition, since the cannon pinion 8 and the hour wheel 10 to which the indicators (not shown) are attached are made larger than in the conventional design, the rocking of the indicator hands due to back lash becomes inconspicuous.

In practice since the forward side wheel chain has been removed, there is sufficient space for an AT-cut plate quartz crystal to be used thereby increasing the accuracy of the electronic timepiece.

In operation the rotor 4 rotates in response to the base signal from quartz crystal oscillator 21. Rotor 4 directly drives the back side minute wheel 9 via the slip-rotor toothed claw $4_c$. The slip-rotor toothed claw $4_c$ also rotates the cannon pinion 8 and hour wheel 10. When the indicator hands are adjusted, the setting wheel 11 is rotated by conventional means and thus the back side minute wheel 9, the cannon pinion 8, and the hour wheel 10 are driven. When the indicator hands are being adjusted, the slip-rotor toothed claw $4_c$ simply idles by slipping on rotor shaft $4_d$, and the permanent magnet $4_b$ and rotor shaft $4_d$ are kept stationary by the magnetic coupling between stator 14 and permanent magnet $4_b$.

Figure 5:
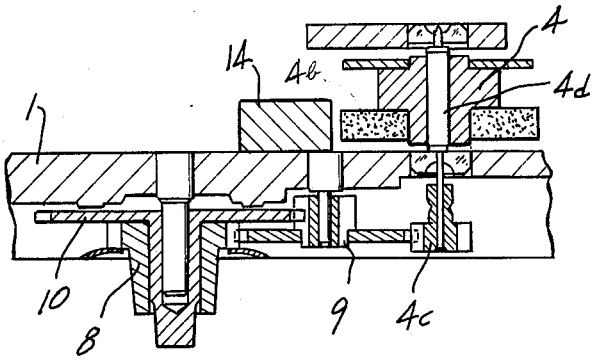
FIG. 5 is a sectional view of a second embodiment of an electronic timepiece in accordance with the teachings of the present invention.

Referring to FIG. 5, shown therein is a second embodiment of an electronic timepiece in accordance with the present invention. In the timepiece of FIG. 5, the location of the cannon pinion 8 and the hour wheel 10 relative to back side minute wheel 9 is reversed. Furthermore, the slip-rotor toothed claw $4_c$ is frictionally coupled to rotor shaft $4_d$ from below the base plate 1. As a result, the height of the hour pointer hand (not shown) relative to the minute pointer hand becomes opposite to the arrangement in conventional timepieces.

Figure 6:
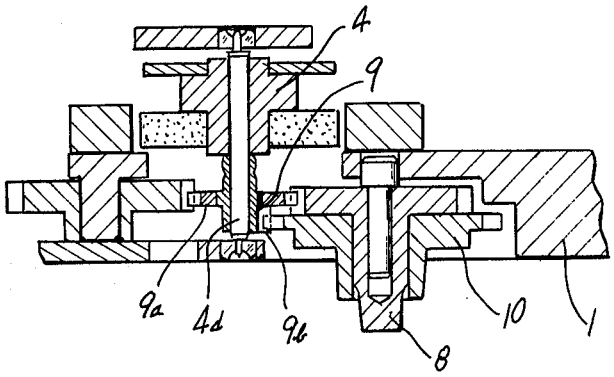
FIG. 6 is a sectional view of a third embodiment of an electronic timepiece in accordance with the teachings of the present invention.
Figure 7:
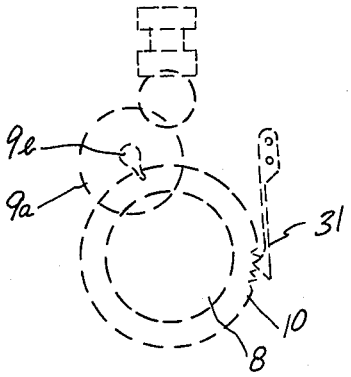
FIG. 7 is a plan view of the embodiment of FIG. 6.

Referring to FIGS. 6 and 7, shown therein is a third embodiment of an electronic timepiece in accordance with the teachings of the present invention. In FIGS. 6 and 7, back side minute wheel 9 is coupled to rotor shaft $4_d$ by friction. As in the first embodiment, the rotor 4 has six magnetic poles and rotates once every 6 minutes. In this embodiment, the back side minute wheel 9 is driven directly by rotor shaft $4_d$. Furthermore, cannon pinion 8 and hour wheel 10 are driven by back side minute wheel $9_a$ and back side minute wheel pinion (claw) $9_b$. Cannon pinion 8 is positioned by index spring 31. Index spring 31 is fastened at one end to base plate 1.

By way of example of the embodiment of FIGS. 6 and 7, the numbers of teeth are six for the back side minute wheel $9_a$, 60 for the hour wheel 8, one for the back side minute wheel pinion (claw) $9_b$, and 120 for the hour wheel 10.

Figure 8:
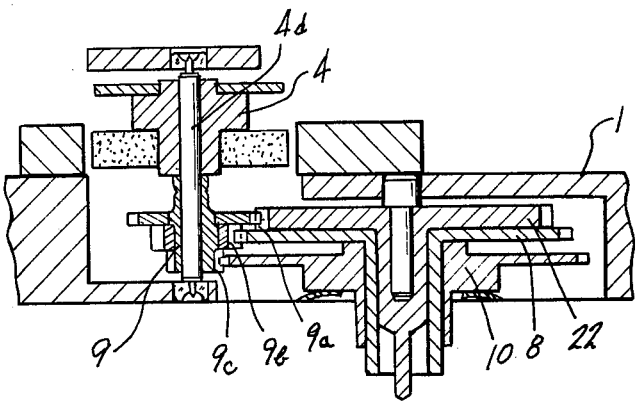
FIG. 8 is a sectional view of a fourth embodiment of an electronic timepiece in accordance with the teachings of the present invention.

FIG. 8 is a fourth embodiment of an electronic timepiece in accordance with the teachings of the present invention. In FIG. 8, the electromechanical transducer is designed such that rotor 4 turns one step per second. Back side minute wheel claw $9_c$, back side minute wheel pinion $9_b$, and minute wheel $9_a$ for the seconds drive all of back side minute wheel 9 are frictionally coupled to rotor shaft $4_d$. Back side minute wheel claw $9_c$, back side minute wheel pinion $9_b$, and minute wheel $9_a$ for the seconds drive engage respectively with hour wheel 10 having an hour pointer (not shown), cannon pinion 8 with a minute pointer (not shown), and second wheel 22 with a second pointer (not shown).

In the description of the previous four embodiments, a stepping motor that turns in one direction is utilized as the electrical to mechanical transducer. A stepping motor may be replaced by a reciprocating motion type, such as a conventional ankle type electromechanical transducer. Furthermore, the number of magnetic poles on the rotor of the step motor is not necessarily limited to six. Furthermore, if the torque applied to the setting wheel 11 during the adjustment of the position of the pointer hands is such that it overcomes the magnetic coupling force between the stator 14 and the permanent magnet $4_b$, it is not necessary to include a frictional coupling between the slip-rotor toothed claw $4_c$, the back side minute wheel 9 and the rotor shaft $4_d$ and a rigid coupling can be used. As to the rocking motions of the pointer hands caused by back lash in the gear trains, although it is possible to decrease the back lash to a negligible level by selecting suitable gear ratios, it is more advisable to adopt such conventionally known methods as restraining springs on the cannon pinion, hour wheel, etc., or application of lateral pressure to push the back side minute wheel itself against the setting wheel 11 and cannon pinion or to utilize a pair of stacked gears that are coupled together with a spring thereby positively eliminating the effect of the back lash.

In short, the invention described above is to provide a means for coupling the driving motion from the moving part of the electromechanical transducer to a portion of the back side wheel chain without going through a chain of front side wheels. Since the invention eliminates the chain of front side wheels that tend to cluster in the central region of the electronic watch, the resulting extra space allows for a more favorable arrangement of the base signal generator and circuit elements such as the battery, IC circuit, quartz crystal and the like thereby making it easier to achieve higher performance, higher precision and a reduction in cost. At the same time elimination of the front side wheels also facilitates miniaturization and a reduction in the thickness of electronic timepieces. Moreover, the assembly process becomes simpler due to the decrease in number of components and thus a savings in cost and an increase in efficiency of the electronic watch due to a simplification of the gear train.

In all cases the utilization of the words "back side wheel train" is in accordance with the customery usage of the words in the timepiece technology and not meant as a constraint in that the back side wheel train must be placed on the underside of the base plate.

In all cases it is understood that the above-described embodiments are merely illustrative of but a small number of the many possible specific embodiments which represent the application of the principles of the present invention. Furthermore, numerous and varied and other arrangements can be readily devised in accordance with the principles of the present invention by those skilled in the art without departing from the spirit and scope of the invention.

We claim:

1. An electronic timepiece comprising:

a means for generating a base signal;

an electromechanical transducer including a rotatable shaft for converting the base signal into mechanical motion of said rotatable shaft;

a back side chain of wheels; and a toothed claw coupled to said rotatable shaft and engaging with said back side chain of wheels whereby said back side chain of wheels is directly driven by said rotatable shaft and whereby a compact timepiece is produced.

2. An electronic timepiece according to claim 1 in which said toothed claw is frictionally coupled to said rotatable shaft such that when an external adjustment is made on said electronic timepiece, said toothed claw idles by slipping on said rotatable shaft.

3. An electronic timepiece according to claim 1 further comprising a wheel pinion coupled to said rotatable shaft and engaging with said back side chain of wheels.

4. An electronic timepiece according to claim 1 wherein said back side chain of wheels comprises:

a minute wheel engaging with said toothed claw;

a minute wheel pinion coupled to said minute wheel;

a cannon pinion engaging with said minute wheel; and an hour wheel engaging with said minute wheel pinion.

5. An electronic timepiece according to claim 3 wherein said back side chain of wheels comprises a cannon pinion engaging with said wheel pinion; and an hour wheel engaging with said toothed claw.

6. An electronic timepiece according to claim 3 further comprising a minute wheel coupled to said rotating shaft, and said back side chain of wheels comprises:

a second wheel engaging with said minute wheel;

a cannon pinion engaging with said minute wheel pinion; and an hour wheel engaging with said toothed claw.

* * * * *